United States Patent [19]

Sood et al.

[11] Patent Number: 5,070,565

[45] Date of Patent: Dec. 10, 1991

[54] UNBALANCED LOAD DETECTION SYSTEM AND METHOD FOR A HOUSEHOLD APPLIANCE

[75] Inventors: Pradeep K. Sood; Douglas M. Petty, both of St. Louis, Mo.

[73] Assignee: Emerson Electric Co., St. Louis, Mo.

[21] Appl. No.: 338,999

[22] Filed: Apr. 17, 1989

[51] Int. Cl.[5] ..... D06F 33/02

[52] U.S. Cl. ..... 8/159; 68/13 R; 68/12.16; 68/23.1

[58] Field of Search ..... 8/158, 159; 68/12 R, 68/13 R, 23.1, 12.16

[56] References Cited

U.S. PATENT DOCUMENTS

| | | | |
|---|---|---|---|
| 3,152,462 | 10/1964 | Elliott et al. | 68/12 R |
| 3,422,957 | 1/1969 | Fosler | 68/12 R X |
| 3,674,419 | 7/1972 | Tichy | 68/23.1 X |
| 4,411,664 | 10/1983 | Rickard et al. | 8/159 X |
| 4,517,695 | 5/1985 | Hoffmann et al. | 68/12 R X |
| 4,677,291 | 6/1987 | Ellingson | 68/23.1 X |
| 4,765,161 | 8/1988 | Williamson | 68/12 R |

*Primary Examiner*—Frankie L. Stinson

*Attorney, Agent, or Firm*—Polster, Lieder, Woodruff & Lucchesi

[57] ABSTRACT

Load unbalance in an inverter driven washing machine is detected by examining the ripple in the DC inverter bus current. Ripple above a predetermined level is indicative of load unbalance. If the ripple indicates the load is unbalanced, the distribution cycle of the washing machine is attempted again in an attempt to more nearly balance the clothes. After a certain number of tries, if the load is still unbalanced the spin cycle is aborted. If the ripple falls below a predetermined level before the maximum number of tries is reached, the spin cycle is started. The frequency of operation is checked during the spin cycle to adjust the cycle time to the particular degree of load balance achieved.

29 Claims, 3 Drawing Sheets

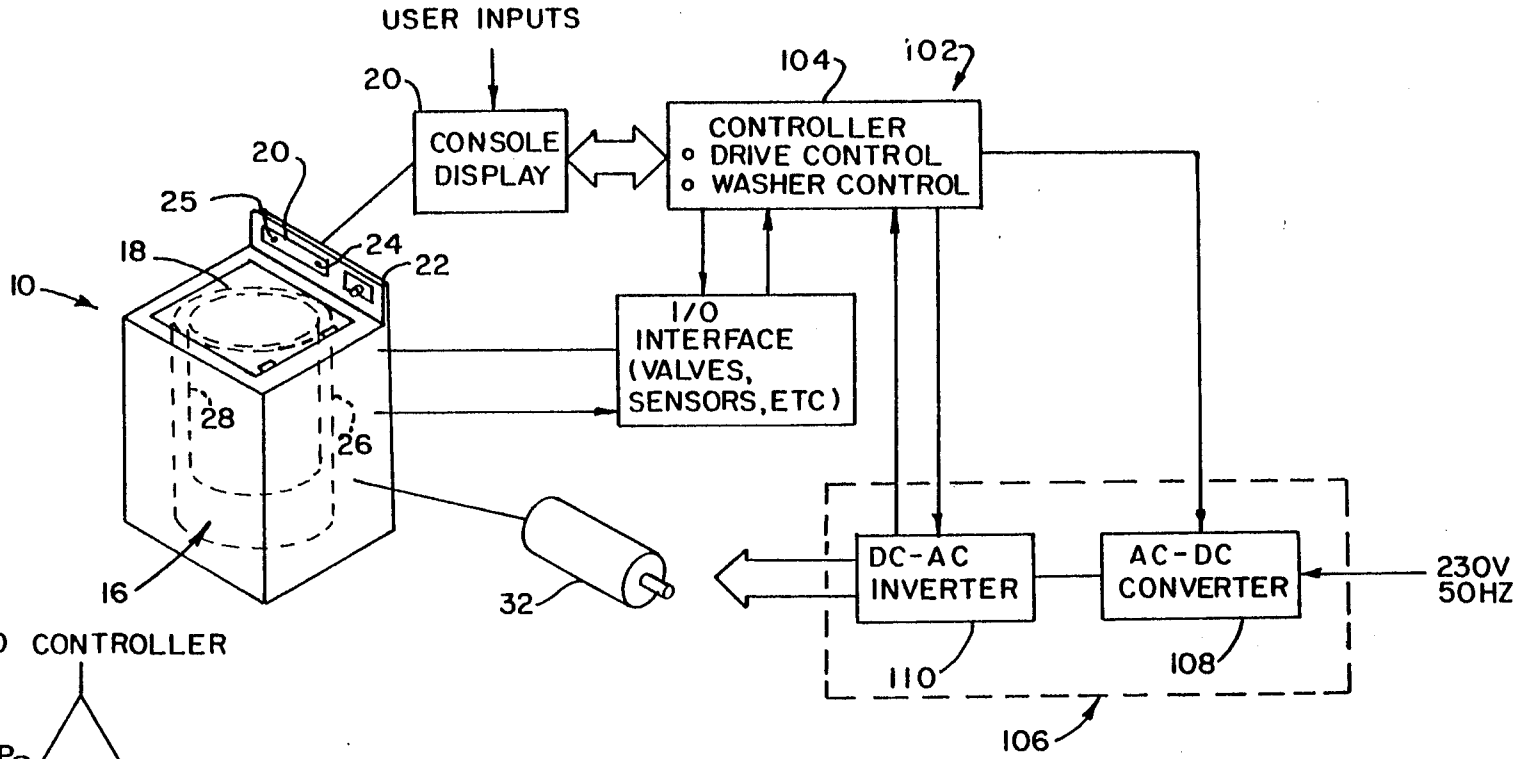
FIG. I.
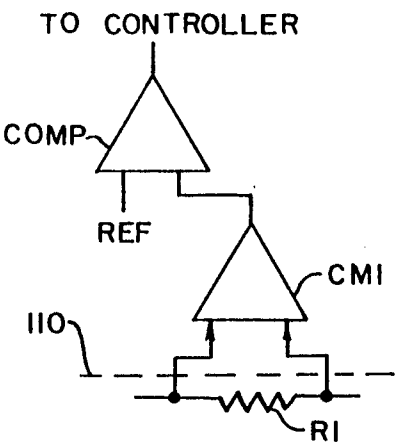
FIG. IA.

UNBALANCED LOAD DETECTION SYSTEM AND METHOD FOR A HOUSEHOLD APPLIANCE

BACKGROUND OF THE INVENTION

This invention relates to electronic control systems for household appliances and, more particularly, to such systems for sensing and correcting load imbalances in a washing machine and aborting a machine cycle if the imbalance cannot be corrected.

Unbalanced loads in washing machines cause excessive mechanical and electrical stresses. It is thus important to be able to sense when an unbalanced load condition exists and to correct it. Sensing of load balance using either mechanical or solid state sensors (load cells, for example) is costly and reduces system reliability. Load balance can also be detected directly by sensing the motor/drum speed of the machine, but this requires costly tachogenerators. In addition, most sensing techniques require extra electrical leads either to the motor or to the rest of the system, which reduces both the reliability and cost-effectiveness of the system.

SUMMARY OF THE INVENTION

Among the several objects and features of the present invention may be noted the provision of an improved system and method for detecting imbalance of the load in an electric motor driven, drum-type washing machine.

Another object is the provision of such a system and method which attempts to correct an imbalance situation before the spin cycle is started.

A further object is the provision of such a system and method which senses imbalance during the spin cycle and corrects the parameters of the spin cycle to compensate.

A fourth object is the provision of such a system and method which enters the machine's spin cycle only if no imbalance is sensed, or a sensed imbalance corrected, and to otherwise terminate machine operation.

A fifth object is the provision of such a system and method which senses the motor frequency during the spin cycle, as an indication of load imbalance.

A sixth object is the provision of such a system and method which sets the length of the spin cycle as a function of any sensed load imbalance.

A seventh object is the provision of such a system and method which terminates the spin cycle if too great a load imbalance is sensed.

An eighth object is the provision of such a system and method which is implemented utilizing existing components in the machine so as to not increase the cost or complexity of the machine.

Other objects and features will be in part apparent and in part pointed out hereinafter.

Briefly, a method of the present invention is directed to sensing and correcting load imbalance in a household appliance such as a washing machine, which appliance has an operational cycle divided into at least a load distribution portion in which the load is distributed with respect to an axis and a post-distribution portion in which the load revolves about the axis of rotation at a relatively high speed. The load is driven by an induction motor powered by a direct current inverter drive. The method includes the step of, at a predetermined point in the load distribution portion of the operational cycle of the appliance, energizing the motor at a predetermined frequency to drive the load at a predetermined nominal speed. The ripple in the direct current through the inverter drive while the motor is energized at the predetermined frequency is examined and compared with a predetermined reference. The post-distribution portion of the operational cycle is started only if the ripple falls below the predetermined reference.

A washing machine of the present invention is capable of sensing and correcting load imbalance. The machine has an operational cycle which includes a distribution cycle and a spin cycle. It includes a drum in which items to be washed are placed, which drum has an axis of rotation about which the drum is rotatable. An induction motor is operatively connected to the drum to drive the drum about its axis of rotation and a direct current inverter drive is provided for powering the motor. A control circuit controls the motor by way of the inverter drive. More particularly the control circuit controls the motor to run the machine through its operational cycle including the distribution cycle in which the items to be washed are distributed about the drum and the spin cycle in which water is removed from the items to be washed. The control circuit is responsive to the machine reaching a predetermined point in the operational cycle for energizing the motor at a predetermined frequency to drive the drum at a predetermined nominal speed. The control circuit examines the ripple in the direct current through the inverter drive when the motor is energized at the predetermined frequency and compares the ripple with a predetermined reference. The control circuit is responsive to the comparison of the ripple with the predetermined reference to start the spin cycle only if the ripple falls below the predetermined reference.

A control system for a washing machine of the present invention is capable of sensing and correcting load imbalance. The machine itself has an operational cycle which includes a distribution cycle and a spin cycle. The machine also has a drum in which items to be washed are placed, the drum having an axis of rotation about which the drum is rotatable. An induction motor is operatively connected to the drum to drive the drum about its axis of rotation. A direct current inverter drive powers the motor. The control system is responsive to the machine reaching a predetermined point in the operational cycle for energizing the motor at a predetermined frequency to drive the drum at a predetermined nominal speed. The system examines the ripple in the direct current through the inverter drive when the motor is energized at the predetermined frequency and compares the ripple with a predetermined reference. The control system is responsive to the comparison of the ripple with the predetermined reference to start the spin cycle only if the ripple falls below the predetermined reference.

BRIEF DESCRIPTION OF THE DRAWINGS

FIG. 1 is a block diagram of a washing machine control system of the present invention;

FIG. 1A is an electrical schematic of a current sensing circuitry in the system of FIG. 1;

Corresponding reference characters represent corresponding parts throughout the several views of the drawings.

DESCRIPTION OF THE PREFERRED EMBODIMENT

Figure 2:
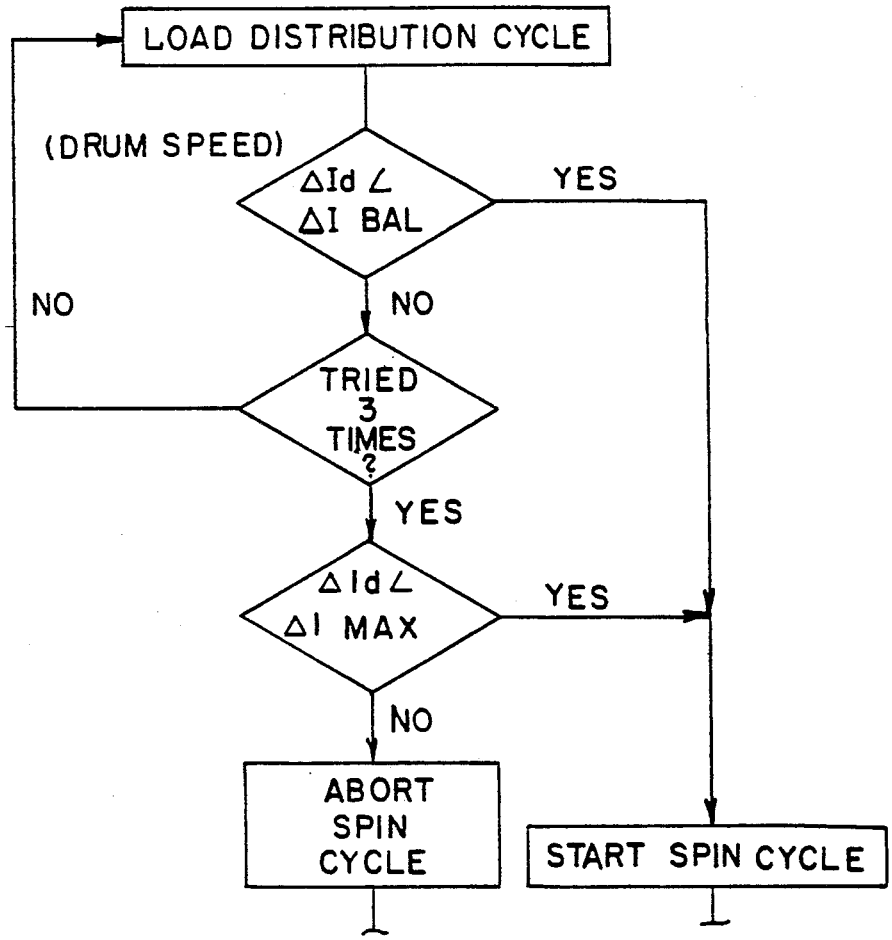
FIG. 2 is a flowchart representing operation of a washing machine during the distribution cycle.

The present invention is embodied in a top load washing machine 10 (FIG. 1) although the invention is not limited to any particular type of washing machine or any particular washing machine construction. Washing machine 10 is a vertical axis agitator type washing machine having a cabinet 16. A hinged lid 18 is provided in the usual manner on the top of the machine for access to the interior of the machine.

A control panel or control console 20 is located at the top rear portion of washing machine 10. Arranged on console 20 are various user selectable controls including a timer 22 and temperature selector 24. Other controls, such as a control switch 25 may be provided. It will be understood that console 20 provides user access to a plurality of appliance performance functions or options among which the user of the appliance may choose. The controls may be implemented by means of push-button switches, touch pads of other suitable user operable switches.

A fluid containing tub 26 is disposed within washing machine 10. A perforated basket or drum 28 is mounted within tub 26 for rotation about a vertical axis. An induction motor 32 is operatively connected to drum 28 to drive the drum through its necessary motions in the operational cycle of the machine. It should be understood that the operational cycle includes a distribution cycle in which clothes to be washed are distributed in the tub and a spin cycle, which follows the distribution cycle, in which water is removed from the clothes in the drum. Those skilled in the art will recognize that a variety of drive arrangements can be utilized with motor 32. Motor 32 may even be directly attached to either the agitator or spin basket of the washing machine to directly control operation of the washing machine. As will be appreciated by those skilled in the art, the washing machine described herein is by way of illustration only. In practice machine 10 may comprise any of a variety of commercially available appliances.

Motor 32 is preferably any of a variety of commercially available induction motors. For example, motor 32 may be a single-phase AC induction motor designed for single-phase, 0–500 hertz operation with a power rating of 500 watts.

The drive system of the present invention controls the functioning of washing machine 10, including the functioning of electric motor 32. A user of the appliance selects from among the various performance options of the appliance and the appliance is controlled by the drive system to operate in accordance with the selected options. The selection means by which the user selects from among the performance options comprises the control console 20. As noted, console 20 includes a plurality of switches, such as switches 24 and 25, by which the user selects those performance options which the user wants the appliance to perform.

The drive system includes a first control means 102 which in the present embodiment is a controller or control circuit 104. It should be understood that the control circuit can include both discrete and integrated devices as will be apparent to those of ordinary skill in the art in view of the present disclosure The control circuit is responsive to the switch settings or options selected by the user. The control circuit monitors the operational status of the appliance through the inputs from various conventional sensors (not shown) such a door position sensor, a sensor indicating the water level in tub 28, and a sensor indicating the water temperature in the tub. In response to these various user and sensor inputs, control circuit 104 controls operation of various washer components such as actuators, valves, pumps and heaters to control operation of the washer. It is through this control function that the control circuit insures that the selected options are performed.

Power for induction motor 32 is supplied via a power means 106. As indicated in FIG. 1, means 106 includes an AC-DC converter 108 connected to the 230 V power main and a DC-AC inverter 110. Both the converter and the inverter are of conventional construction.

Inverter 110 is a 6-step inverter whose construction is well known in the art. The inverter includes a current sensing resistor R1 (see FIG. 1A) which supplies voltage and current information to the control circuit In return, control circuit 104 supplies control signals to the converter and the inverter.

During a washing machine cycle, motor 32 is operated at various speeds. In addition, the motor is required to start and stop numerous times, the rate of motor acceleration and deceleration varying. The drive for motor 32 is provided by the output of inverter 110.

The method of the present invention utilizes these existing components to sense a load imbalance during machine operation, and to correct the imbalance. To this end, at a predetermined point during a load distribution cycle (see FIG. 2), the drum is brought up to a nominal operating speed. This speed is controlled by the frequency of the inverter. During this step the controller 102 keeps this inverter frequency fixed. During the "ramp-up" period, the items of clothing loaded into drum D are distributed within the drum. Once the drum is rotating "at speed", the load is checked for unbalance.

Unbalance in the present invention is detected by monitoring the bus current $I_{DC}$ supplied by the inverter. As shown in FIG. 1A, current sensing resistor R1 in the inverter and a comparator CM1 supply a representative signal to a comparator COMP which compares this input with a value representative of the current if the load were balanced, $I_{BAL}$.

Figure 3:
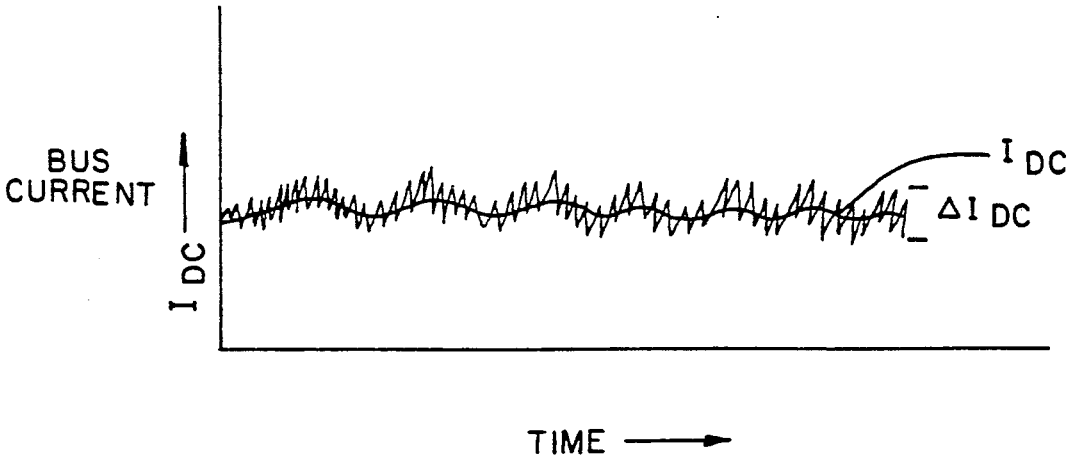
FIG. 3 is a graph representing bus current in the inverter drive by means of which load imbalance is sensed; and, FIG. 4 is a flowchart of the operation of the washing machine in the spin cycle.

The bus current $I_{DC}$ is graphically represented in FIG. 3. As shown therein, any load imbalance appears as a ripple delta-$I_{DC}$ on the bus current. The greater the load imbalance, the greater the magnitude of the ripple. The output of comparator COMP is an input to the rest of the controller. If there is little or no sensed ripple in the bus current, indicative of an essentially balanced load, a "continue as is" signal is provided so that the machine maintains its operational cycle and can then enter the spin cycle. If there is a significant sensed ripple, indicative of an unbalanced load, the control logic will attempt to redistribute the load. The controller accomplishes this by restarting the load distribution cycle as indicated in FIG. 2. After another time interval, the bus current will be sensed again to see if the load has been redistributed and is now balanced.

The system will repeat this process up to three times in an attempt to redistribute the load. If at the end of three times, the ripple in the inverter current still indicates that the load is unbalanced, by comparison with a reference delta-$I_{MAX}$, which may or may not be the same as delta-$I_{BAL}$, the operational cycle of the machine, and in particular the subsequent spin cycle, is aborted.

On the other hand, if at the end of any of these distribution cycles, the ripple falls below the reference, the machine goes into a spin cycle, as indicated in FIG. 2.

Figure 4:
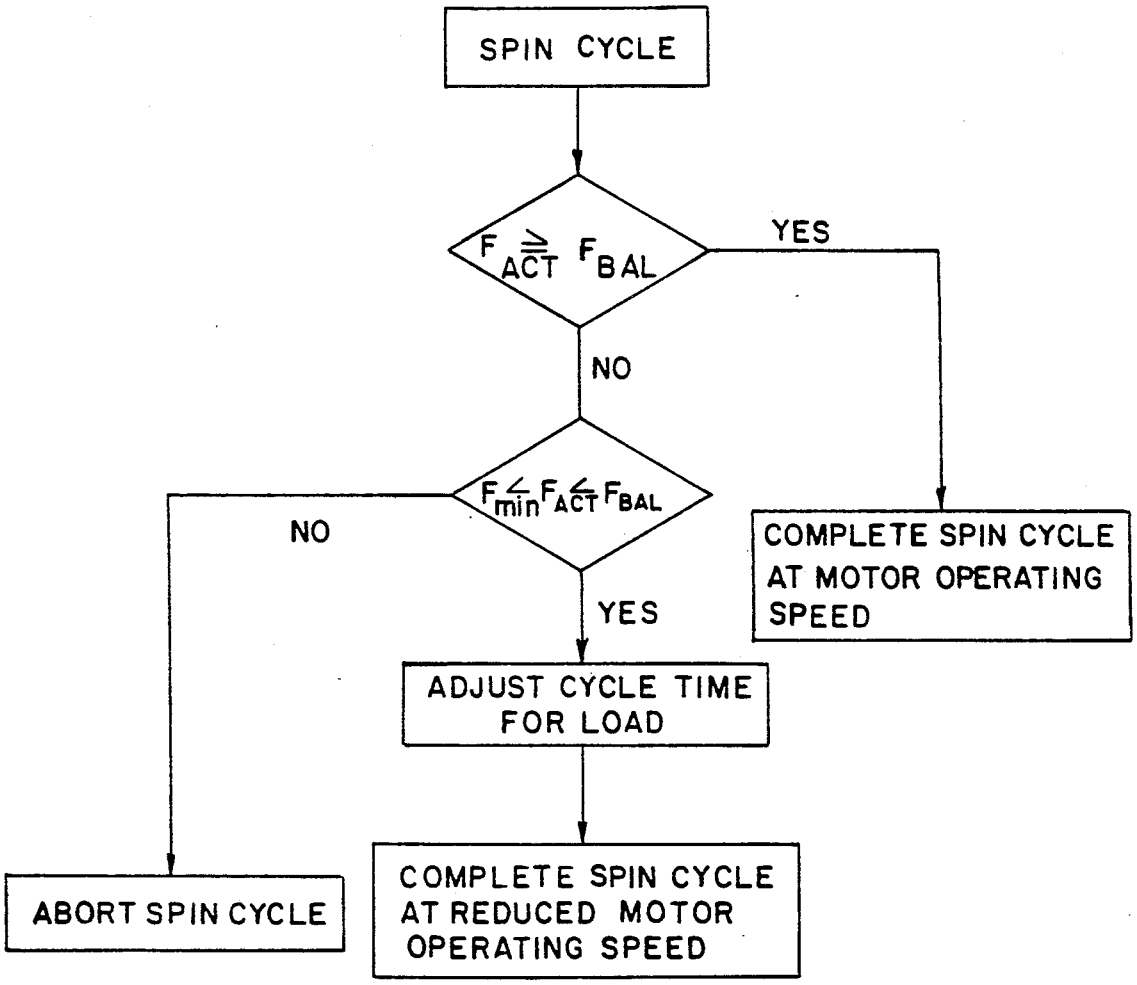

Referring to FIG. 4, once a spin cycle has been initiated, the length of the spin cycle is determined on the basis of the magnitude of any remaining load imbalance. For this purpose, the frequency of the signal provided the motor by the inverter is checked at least once during the spin cycle. This frequency is readily available from standard inverters and again requires no additional components. The frequency representative signal $F_{ACT}$ is compared to a frequency reference representing the frequency, $F_{BAL}$, the motor would operate at if the load were balanced. Because the controller is designed to automatically reduce the motor frequency if its current and power limits are reached, the motor will reach its specified or nominal operating frequency, $F_{BAL}$, only if the load is essentially balanced.

As shown in FIG. 2, and in accordance with the method of this invention, if the actual motor frequency $F_{ACT}$ equals or exceeds the predetermined nominal balance frequency $F_{BAL}$, the spin cycle proceeds for its preset standard time. If, however, the frequency signal is less than the nominal value but greater than a predetermined percentage $XF_{BAL}$ thereof (indicating some undesirable but acceptable load imbalance), the control logic will adjust the length of the spin cycle to compensate for the reduced spin rate.

In the last instance, if the motor frequency is less than the predetermined percentage of the nominal frequency, indicating a significant load imbalance, the spin cycle will be aborted and the machine stopped.

It will be understood that the method of this invention is implemented utilizing existing equipment in the washing machine as to not overly complicate the machine and increase costs.

Having thus described the invention, what is claimed and desired to be secured by Letters Patent is:

1. A method of sensing and correcting load imbalance in a household appliance such as a washing machine, said appliance having an operational cycle divided into at least a load distribution portion in which the load is distributed with respect to an axis and a post-distribution portion in which the load revolves about the axis of rotation at a relatively high speed, said load being driven by an induction motor powered by a direct current inverter drive, said method comprising:

at a predetermined point in the load distribution portion of the operational cycle of the appliance, energizing the motor at a predetermined frequency to drive the load at a predetermined nominal speed;

examining the ripple in the direct current through the inverter drive while the motor is energized at the predetermined frequency, and comparing said ripple with a predetermined reference; and starting the post-distribution portion of the operational cycle only if the ripple falls below the predetermined reference.

2. The method as set forth in claim 1 further including attempting to redistribute the load if the ripple exceeds the predetermined reference.

3. The method as set forth in claim 2 wherein the attempting step includes restarting at least part of the load distribution portion of the operational cycle of the appliance to attempt to redistribute the load.

4. The method as set forth in claim 2 further including repeating the examining step after completion of the attempting step to determine if the ripple falls below the predetermined reference after the attempted redistribution of the load.

5. The method as set forth in claim 4 wherein the attempting step and subsequent examining step are repeated a predetermined plurality of times if necessary to balance the load.

6. The method as set forth in claim 5 wherein the operational cycle of the appliance is terminated if the load remains unbalanced after the attempting and examining steps are repeated said predetermined plurality of times.

7. The method as set forth in claim 1 further including the step of sensing the frequency of revolution of the load during the post-distribution portion of the operational cycle of the appliance and terminating the operational cycle if the frequency falls below a predetermined reference frequency.

8. The method as set forth in claim 7 wherein the load revolution frequency is sensed by examining the inverter frequency of operation.

9. The method as set forth in claim 8 wherein the load revolution frequency is sensed at a predetermined time after initiation of the post-distribution portion of the operational cycle.

10. A washing machine capable of sensing and correcting load imbalance, said machine having an operational cycle which includes a distribution cycle and a spin cycle, said machine comprising:

a drum in which items to be washed are placed, said drum having an axis of rotation about which the drum is rotatable;

an induction motor operatively connected to the drum to drive the drum about its axis of rotation;

a direct current inverter drive for powering the motor;

control means for controlling the motor by way of the inverter drive, said control means controlling the motor to run the machine through its operational cycle including the distribution cycle in which the items to be washed are distributed about the drum and the spin cycle in which water is removed from the items to be washed;

said control means including means responsive to the machine reaching a predetermined point in the operational cycle for energizing the motor at a predetermined frequency to drive the drum at a predetermined nominal speed;

said control means further including means for examining the ripple in the direct current through the inverter drive when the motor is energized at the predetermined frequency and for comparing the ripple with a predetermined reference;

said control means being responsive to the comparison of the ripple with the predetermined reference to start the spin cycle only if the ripple falls below the predetermined reference.

11. The washing machine as set forth in claim 10 wherein the control means is responsive to the machine being at a predetermined point in the distribution cycle to examine and compare the ripple in the direct current through the inverter drive.

12. The washing machine as set forth in claim 11 wherein the control means further includes means for controlling the motor to attempt to redistribute the load if the ripple exceeds the predetermined reference.

13. The washing machine as set forth in claim 12 wherein the control means restarts at least part of the load distribution cycle to attempt to redistribute the load.

14. The washing machine as set forth in claim 12 wherein the control means includes means for repeating the examination of said ripple after completion of the attempted redistribution of the load to determine if the ripple falls below the predetermined reference after the attempted redistribution of the load.

15. The washing machine as set forth in claim 14 wherein the control means includes means for repeating the attempt to redistribute the load and the subsequent examination of said ripple a predetermined plurality of times if necessary to balance the load.

16. The washing machine as set forth in claim 15 wherein the control means includes means for terminating the operational cycle of the washing machine if the load remains unbalanced after the attempt to redistribute the load and the subsequent examination of said ripple are repeated said predetermined plurality of times.

17. The washing machine as set forth in claim 10 wherein the control means includes means for sensing the frequency of revolution of the load during the spin cycle of the washing machine and for terminating the operational cycle if the frequency falls below a predetermined reference frequency.

18. The washing machine as set forth in claim 17 wherein the control means includes means for sensing the load revolution frequency by examining the inverter frequency of operation.

19. The washing machine as set forth in claim 18 wherein the load revolution frequency is sensed at a predetermined time after initiation of the spin cycle.

20. A control system for a washing machine capable of sensing and correcting load imbalance, said machine having an operational cycle which includes a distribution cycle and a spin cycle, said machine also having a drum in which items to be washed are placed, said drum having an axis of rotation about which the drum is rotatable, an induction motor operatively connected to the drum to drive the drum about its axis of rotation, and a direct current inverter drive for powering the motor, said control system comprising:

means responsive to the machine reaching a predetermined point in the operational cycle for energizing the motor at a predetermined frequency to drive the drum at a predetermined nominal speed;

means for examining the relatively high frequency ripple in the direct current through the inverter drive when the motor is energized at the predetermined frequency and for comparing the ripple with a predetermined reference;

said control system being responsive to the comparison of the ripple with the predetermined reference to start the spin cycle only if the ripple falls below the predetermined reference.

21. The control system for a washing machine as set forth in claim 20 wherein the examining and comparing means is responsive to the machine being at a predetermined point in the distribution cycle to examine and compare the ripple in the direct current through the inverter drive.

22. The control system for a washing machine as set forth in claim 21 further includes means for controlling the motor to attempt to redistribute the load if the ripple exceeds the predetermined reference.

23. The control system for a washing machine as set forth in claim 22 wherein the system restarts at least part of the load distribution cycle to attempt to redistribute the load.

24. The control system for a washing machine as set forth in claim 22 further including means for repeating the examination of said ripple after completion of the attempted redistribution of the load to determine if the ripple falls below the predetermined reference after the attempted redistribution of the load.

25. The control system for a washing machine as set forth in claim 24 further including means for repeating the attempt to redistribute the load and the subsequent examination of said ripple a predetermined plurality of times if necessary to balance the load.

26. The control system for a washing machine as set forth in claim 25 further including means for terminating the operational cycle of the washing machine if the load remain unbalanced after the attempt to redistribute the load and the subsequent examination of said ripple are repeated said predetermined plurality of times.

27. The control system for a washing machine as set forth in claim 20 further including means for sensing the frequency of revolution of the load during the spin cycle of the washing machine and for terminating the operational cycle if the frequency falls below a predetermined reference frequency.

28. The control system for a washing machine as set forth in claim 27 further including means for sensing the load revolution frequency by examining the inverter frequency of operation.

29. The control system for a washing machine as set forth in claim 28 wherein the load revolution frequency is sensed at a predetermined time after initiation of the spin cycle.

* * * * *